United States Patent [19]

Schagen et al.

[11] 3,939,374

[45] Feb. 17, 1976

[54] ELECTRON MULTIPLIERS HAVING TAPERED CHANNELS

[75] Inventors: Pieter Schagen; Hewson Nicholas Graham King; Daphne Louise Lamport; Roger Pook; Pamela May Stubberfield; Derek Washington, all of Salfords, near Redhill, England

[73] Assignee: U.S. Philips Corporation, New York, N.Y.

[22] Filed: Jan. 7, 1974

[21] Appl. No.: 431,016

[30] Foreign Application Priority Data

Nov. 6, 1973 United Kingdom ..... 2842/73

[52] U.S. Cl. ..... 313/95; 313/105 CM

[51] Int. Cl.[2] ..... H01J 43/24; H01J 43/22

[58] Field of Search .... 313/104, 103, 105, 105 CM, 313/95

[56] References Cited

UNITED STATES PATENTS

| | | | |
|---|---|---|---|
| 2,429,772 | 10/1947 | Roman | 313/95 |
| 3,176,178 | 3/1965 | Goodrich et al. | 313/104 |
| 3,497,759 | 2/1970 | Manley | 313/105 X |
| 3,758,781 | 9/1973 | Schmidt | 313/104 |

OTHER PUBLICATIONS

Lester, "Off-Axis Channeltron Multiplier for Quadrupole Mass Spectrometers," Review of Scientific Instruments, Vol. 41, No. 10, (Oct., 1970), p. 1513.

*Primary Examiner*—Robert Segal

*Attorney, Agent, or Firm*—Frank R. Trifari; Ronald L. Drumheller

[57] ABSTRACT

A channel plate electron multiplier having channels which rapidly decrease in cross-section away from the input aperture and a conductive structure extending across the input aperture to flatten any fringing electrostatic field, resulting in an electrostatic field configuration which causes secondary emitted electrons to collide with the same side of the channel.

9 Claims, 18 Drawing Figures a b a b

ELECTRON MULTIPLIERS HAVING TAPERED CHANNELS

Figure 1:
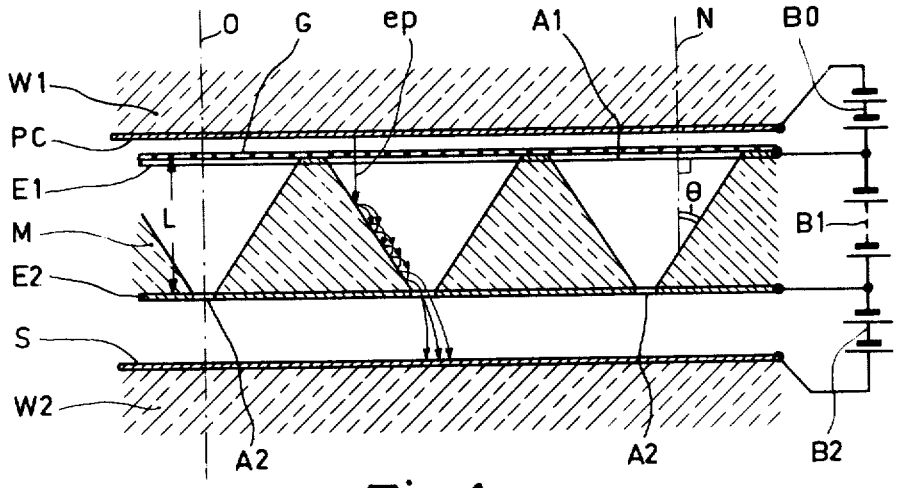

This invention relates to electron multipliers and more particularly to electron multipliers of the channel plate type. The invention can be applied with particular advantage to channel plates for use in electronic imaging and display tube applications.

The type of device currently known as a "channel plate" can be defined as a secondary-emissive electron-multiplier device comprising a matrix in the form of a plate having a large number of elongate channels passing through its thickness, said plate having a first conductive layer on its input face and a separate second conductive layer on its output face to act respectively as input and output electrodes.

The invention relates more particularly to channel plates of the continuous dynode type. This is a convenient term for channel plates having what is at present the conventional form of construction. Such channel plates can be regarded as continuous dynode devices in that the secondary-emissive material of the channels is continuous (though not necessarily uniform) in the direction of the channels.

Continuous dynode channel plates are described, for example, in British Pat. No. 1,064,073, and in U.S. Pat. No. 3,260,876, 3,337,137, 3,327,151 and 3,497,759, while methods of manufacture are described in British Pat. Nos. 1,064,072 and 1,064,075.

In the operation of continuous dynode plates a potential difference is applied between the two electrode layers of the matrix so as to set up an electric field to accelerate the electrons, which field establishes a potential gradient created by current flowing through resistive surfaces formed inside the channels or (if such channel surfaces are absent) through the bulk material of the matrix. Secondary-emissive multiplication takes place in the channels and the output electrons may be acted upon by a further accelerating field which may be set up between the output electrode and a suitable target, for example a luminescent display screen.

Channel plates can be used in imaging tubes of various kinds, for example scanning tubes such as cathode-ray tubes and camera tubes and non-scanning image intensifier tubes (this Specification will, for convenience, refer to an image intensifier tube in those terms rather than as an "image converter" tube even in applications where the primary purpose is a change in the wavelength of the radiation of the image).

In a conventional continuous-dynode channel plate the gain is critically dependent on the ratio of channel length to diameter (the "L/D" ratio). This results in a number of manufacturing problems, and the solution of two of these is particularly desirable. The first is the extremely high degree of fibre size control required during the tube drawing processes normally used. Fibre diameter variations of little more than ± 1% have been detected as gain variations over the finished plate. The second problem is the need for an L/D ratio of not less than about 40 which renders fibre-drawing techniques virtually unavoidable in present practice. These problems conspire to render the normal manufacturing process both costly and time-consuming, especially for large-area arrays.

A third problem is the "chicken wire" pattern normally produced around the periphery of the multifibre units when a multi-draw fibre system is used (channel plates are normally made by fibre drawing techniques similar to those used to make fibre optics).

According to a first aspect the invention provides a modified continuous dynode channel plate wherein the channels have a. an L/Di ratio (as herein defined) not greater than three;

b. an Ai/Ae ratio (as herein defined) not less than five; and c. a channel form such that each channel has its secondary-emissive multiplier surfaces inclined to the normal to the faces of the plate for at least two thirds of the axial length of the channel in such a manner that said surfaces provide together a tapered channel form with a maximum cross-section at its input aperture reducing progressively to a minimum cross-section at or near its exit aperture.

The L/Di ratio is the ratio between the axial length L of a channel and the diameter or width Di of its input aperture, said aperture being the cross-section of largest area (in the case of a circular aperture the diameter is taken as Di; with other shapes, the smallest width is taken as Di, e.g. in the case of a square aperture the side is taken as Di rather than the diagonal). Since the channels according to this invention are tapered, the L/Di ratio is a parameter which conveniently replaces the L/D ratio used for conventional (constant-diameter) channels. It is significant that the value of L/Di is restricted to a maximum value of 3 (and can advantageously be as small as 2 or 1, or even less) whereas conventional channels have to be very long and narrow, with normal L/D ratios of about 40 as aforesaid.

The Ai/Ae ratio is the ratio between the area of the input aperture (Ai) of a channel and the area of its exit aperture (Ae) and, as will be seen, this value may advantageously be as much as 25 or more. (In the case of a conventional parallel channel this ratio is, of course, equal to unity).

The criteria (a), (b), (c), which define the first aspect of the invention result in very shallow tapered channel forms which permit a channel plate to be made by relatively simple and inexpensive processes, e.g. by molding or by pressing indentations in a pre-formed sheet.

The invention permits such methods to be readily applied to large-area plates as may be required for X-ray image intensifiers and cathode-ray tubes for T.V. display and like purposes.

The tapered channel form has a concomitant advantage in that its electron multiplier surfaces readily conform to angles of inclination which are advantageous from the point of view of electron multiplication efficiency. Thus, according to a second aspect, the invention provides a modified channel plate wherein each channel has at least the major part of its electron multiplier surfaces inclined to the normal to the faces of the plate at angles $\theta$ in the range 10° - 60°. From the point of view of multiplier efficiency, the angles $\theta$ are not the primary controlling factor, the directly significant factor being the angle $e$ that an equipotential surface forms with the respective secondary-emissive multiplier surface, and this latter angle may depend not only on the channel profile but also on the shape of the electric field configuration which prevails outside the input aperture of the channel when the channel plate is in operation inside a tube. This will be explained in greater detail but meanwhile it may be helpful to note that the angle $e$ is preferably in the range 50° - 75°, optimum values being 60° – 70° for many applications. Apart from assisting in rendering practicable the aforesaid molding and pressing methods of manufacture, the use of the selected range of values for the angle $\theta$ has the indirect effect of enabling the equipotential angles $e$ to be brought within their preferred range of 50° – 75° or at least facilitating such restriction. In some cases the shape of the channels (as determined by $\theta$ angles within the range 10° – 60°, and preferably 15° – 35°) is sufficient to control the form of the equipotentials and maintain their angles $e$ at values within the preferred $e$ ranges. In other cases the channel plate may have to rely on external means to optimise or control the field configuration on the input side, and such control may be exerted e.g. by the photo-cathode in the case of an image intensifier of the proximity type. In the absence of such means, it may be desirable or necessary to combine the channel plate with a conductive grid which, from a constructional point of view, is preferably in contact with the input electrode of the plate or forms part thereof and preferably is of such pitch and position as to ensure that at least one, and preferably several grid conductors are present across the input aperture of each channel.

Examples will be given of conical and pyramidal channel forms in which all the multiplier surfaces lie within the preferred $\theta$ range of 15° – 35° and the effects of varying the angles $e$ and $\theta$ will be explained.

Examples of L/Di ranges less than unity will also be given. By contrast, in U.s. Pat. No. 3,176,178 it has been proposed to provide an electron multiplier device which comprises a nest of closely spaced channels, each channel being bounded laterally by a continuous secondary-emissive coating surface, each channel having a relatively large length-to-mean-width ratio at least equal to 10 and presenting a conical shape over at least a part of its length; a common source of primary particles extending near one end of said nest and a common collector for multiplied particles extending near the other end of said nest. However, the small degree of channel taper and relatively high length-to-mean-width ratios envisaged (10 or greater) would not permit the kind of cheap and simple mass-production methods referred to above, especially in those cases in which the channels are parallel for most of their length.

The present invention may employ a plate configuration wherein each channel has a tapered profile in every axial plane (for the purposes of this Specification the axis of a channel is normal to the faces of the plate and is at the center of a symmetrical channel or at the center of the exit aperture in the case of an asymmetrical channel; an axial plane is a plane containing said axis and providing an axial section).

As will be seen, the tapered profile of a channel may be straight as in the examples of channels of simple conical or pyramidal form. Alternatively each profile may be made up of straight sections having different angles of inclination, or curved, as will be explained with the aid of examples.

Figure 2:
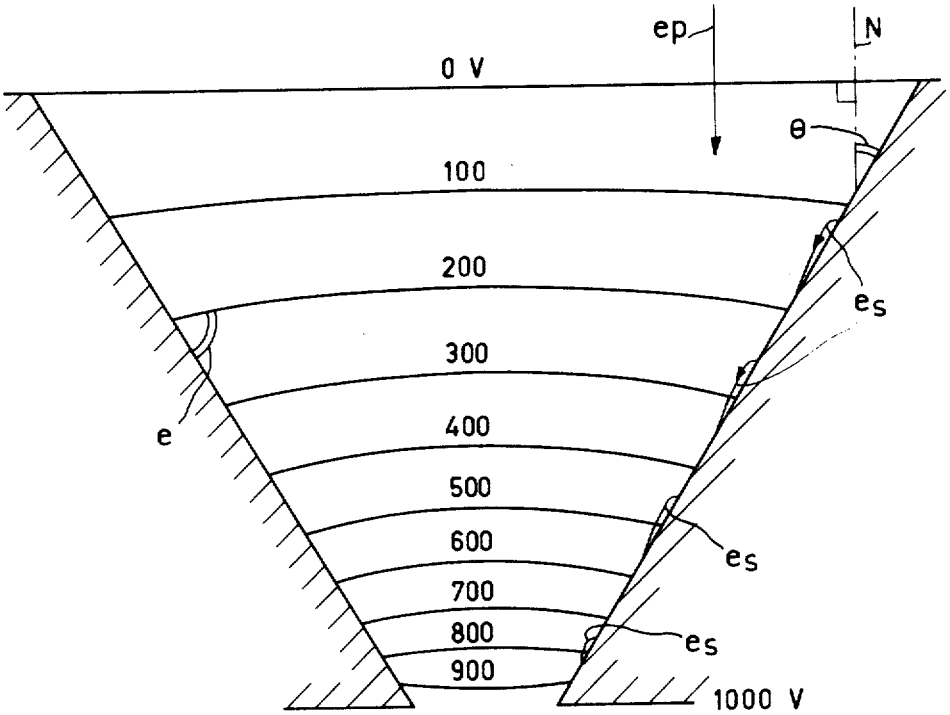

Embodiments of the invention will now be described by way of example with reference to the accompaying diagrammatic drawings, in which FIG. 1 is a fragmentary axial section of a channel plate having straight-sided channels in combination with an input grid and forming part of an electron multiplier or image intensifier tube of the proximity type;

FIG. 2 illustrates the electric field configuration in a conical channel having surface conduction and an input grid, and FIGS. 3 to 10 illustrate a variety of alternative channel shapes.

FIGS. 11 to 17 of the accompanying drawings illustrate diagrammatically further channel shapes and methods of manufacture.

The general characteristics and mode of operation of a modified channel plate according to the invention will first be described with reference to FIGS. 1 and 2 on the assumption that the channels shown are conical, although most of the points made (and the section of FIG. 1) will be the same for channels of square pyramidal form having the same angle $\theta$ of inclination.

The plate shown in FIG. 1 has a matrix M which may be an apertured sheet of glass having resistive (i.e. slightly conductive) secondary-emissive multiplier surfaces formed on the conical walls of its channels. In this example the surfaces extend over the full axial length L (FIG. 1) of the channels (a channel axis is shown at 0).

An input electrode E1 is formed on the input face of the plate and an output electrode E2 on its output face.

A planar photo-cathode is indicated at PC on a transparent support W1 which may be a window forming part of the envelope of the tube.

Similarly, a display screen is shown at S on a transparent support W2 which may be also a window forming part of the envelope.

The screen S includes a conductive layer and appropriate potentials are applied to elements PC, E1, E2 and S by HT sources shown schematically at Bo-B1-B2.

In addition, a grid G is provided on and in contact with electrode E1 in order to improve the field configuration inside the channels (the configuration shown in FIG. 2 is due in part to the presence of such a grid). The pitch and position of grid G must be such as to ensure that at least one, and preferably several grid conductors are present across the input aperture A1 of each channel.

The angle $\theta$ of inclination is indicated in both Figures by reference to a line N normal to the faces of the plate.

FIG. 2 is based on the case of an insulating matrix having conical channels and resistive surfaces thereon, i.e. on the surface-conduction case (for bulk conduction the field configuration differs in a manner which will be explained and it depends on the distribution of the volume of bulk matrix material around each channel). In FIG. 2 the potential difference applied by source B1 is assumed to be 1000V and 100V equipotentials are drawn for an axial section of a conical channel. The "zero"-volt surface is set by the grid G across the channel entrance. The paths of four secondary electrons ($e_s$) are shown, these being assumed by way of example, and for convenience of comparison, to leave the surface at 90° with an initial energy of 2 eV.

In such a conical structure the equipotentials (FIG. 2) are more or less parallel to the input and output faces partly as a result of the action of grid G. The angles $e$ of the equipotentials are in the preferred range 60° – 70°. Secondary electrons emitted from the wall are therefore attracted down the inclined sides and impact on the wall without crossing over the cone. Providing they have acquired sufficient energy, these electrons will produce further secondaries and so forth. If the conducting grid G were not present, equipotential surfaces would bow out of the channel entrance or input aperture, and secondaries from the input end would not be accelerated back into the wall soon enough, but would travel a long way down the channel, or even right through its exit aperture thus lowering the average number of collisions and hence lowering the gain.

The field configuration of FIG. 2 (which is based on surface conduction) is advantageous in that the area of highest field gradient is around the exit aperture and, since such area will cause most of the collisions and, therefore, most of the gain, most of the primary electrons captured by the channel will benefit from this high-gain area. Conversely, with bulk conduction the equipotentials are crowded near the input aperture of the channel and therefore many primary electrons will miss the high-gain area by landing farther down the tapered surface.

To improve the field configuration in respect of angles *e* it is possible to give the grid G (FIG. 1) a slight outward curvature so that the upper equipotentials become more convex.

There is the advantage that ions travelling back through a channel will not strike the channel wall and therefore will not produce spurious secondary electrons therefrom. However, if a grid G is used on the input side, ions can strike the grid and secondaries may be produced which can give rise to ionic feedback at high operating voltages. This effect can be minimized by both maximizing the transparency of the grid and minimizing its secondary emission coefficient. Another problem is that at high gain the pulse/height distribution is less peaked than that of comparable conventional channels. This is because incoming particles are not confined to the input end of a channel and may, instead, strike the wall at any point along the length of the multiplying surface. Some output pulses will thus be the product of multiplication along only part of the channel length, but this does not matter much for the applications mentioned below.

Channel plate constructions according to the invention are at this stage mainly suitable for relatively coarse resolution devices because (a) manufacturing techniques are difficult with very small conical and pyramidal channels and (b) voltage gradients are apt to become excessive for very thin plates. At present the main applications are considered to be large-area image intensifiers (typically medical X-ray applications) and cathode-ray display tubes.

From the point of view of multiplying efficiency the optimum value of the angle *e* (FIG. 2) appears to be 60° – 70° and for straight-sided channel multiplier surfaces this can readily be achieved with $\theta$ angles of 25° to 30°. At smaller values of *e* the secondary electrons return to the wall too soon and do not acquire sufficient energy to produce further secondaries. At larger values of *e* the reverse happens and, although secondaries are produced, the average number of collisions is reduced thus lowering the gain. As *e* is increased still futher, electrons will cross to the opposite wall and the multiplier begins to operate as a conventional channel, in which case it will be less efficient owing to the fact that the channel length is so much less than that of a comparable conventional parallel channel.

As with conventional channel plates, the devices may be scaled up or down in size without altering the gain.

Two distinct types of material are given as examples of materials suitable for channel plates according to the invention. The first includes conducting glasses (either bulk or surface conducting) as used for conventional channel multipliers, and conductive ceramics. As was stated in the preamble, the required current flows through resistive surfaces formed inside the channels ("surface conduction" type of channel plate) or through the bulk material of the matrix ("bulk conduction" type). Suitable glasses exist for both types. For surface conduction, the usual way of obtaining resistive surfaces inside the channels of an insulating matrix is to use a lead-glass and, as one of the last steps in the manufacturing process, to reduce some of the lead oxide to lead at the channel surfaces.

The second type of material includes various metals, for example aluminum. In this case it is necessary to coat the channels and one or both of the end faces of the plate with an insulating material, for example alumina. Then each insulated face has a conducting electrode deposited on top of the insulation, and a resistive secondary-emitting layer is applied inside channels. Such a layer may be in two parts, as is done e.g. by Nillson et al (Nuclear Instruments and Methods 84 (1970) 301 – 306) who use a semi-conducting Si layer 500A thick superimposed by 60A of alumina as a secondary-emitting surface in a parallel-plate multiplier.

As for methods of channel formation, glass or metal multiplier plates can be prepared by molding or pressing, in which case square, triangular or hexagonal sectioned pyramidal channels may be preferable to round conical ones due to the simpler mould or die construction and greater useful area. Thus a mould or die can be formed from a sheet or plate e.g. my machining a first set of parallel V-shaped grooves and this procedure can then be repeated at 90° so as to leave a regular array of square pyramids which can then be used as part of a mould or to press or indent pyramidal channels in a sheet of appropriate material. Similarly, if hexagonal pyramids are required, the mould or die may be formed by machining three sets of V-shaped grooves which intersect each other at 120°.

If a metal sheet is used as the basis for the channel plate matrix as mentioned above, spark erosion can also be used and can be carried out with the aid of conical, pyramidal or like electrodes.

Arrays of conical multipliers have been constructed in the laboratory with input diameters Di of approximately 0.5 mm., 0.1 mm. exit diameters, and a length L of 0.5 mm., and with angles $\theta$ of about 30°. With a grid G and a voltage of 1500V gains of up to $10^4$ have been measured. The Ai/Ae ratio for such a channel form is 25.

Having described in some detail (with reference to FIGS. 1 and 2) an example in which the channels are conical, i.e. in which the angle of inclination $\theta$ is constant for all the secondary emissive multiplier surfaces, other possible forms of channel will now be described with reference to FIGS. 3 to 9 assuming that a grid G is provided as in FIGS. 1 and 2 although such grid is omitted from these further drawings for the sake of clarity.

Figure 3:
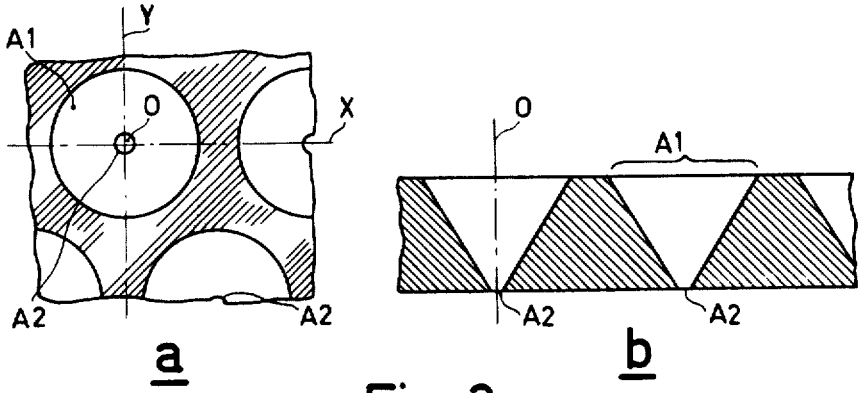

First, as was indicated earlier, the axial section of FIG. 1 pertains also to the case of regular square pyramidal channels. In both the conical and square pyramidal cases the profile of a channel is the same in two orthogonal axial planes which we may refer to as the X and Y planes. This is illustrated in FIG. 3 which shows conical channels (similar to those of FIG. 1) in plan view (FIG. 3*a*) and in an axial section (FIG. 3*b*) which is identical for both the X and Y planes. Both of the planes X and Y (which are indicated on FIG. 3*a*) contain the channel axis 0 in accordance with the definition of an axial plane.

Figure 4:
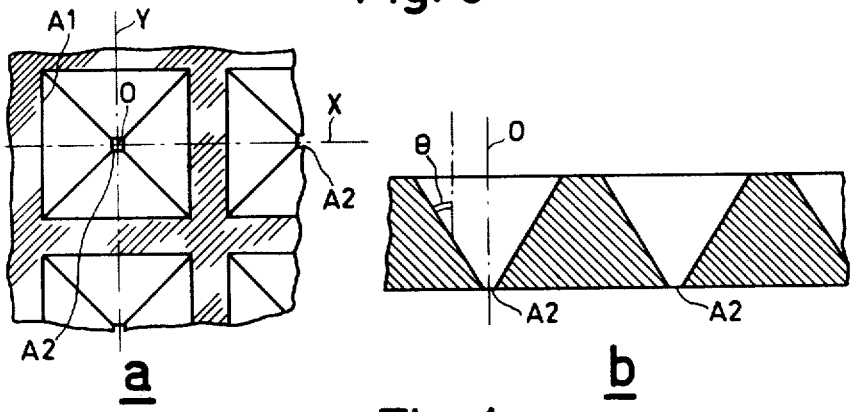

In the equivalent square pyramidal case (FIG. 4) there is a better utilization of the area of the channel plate and the channels may have the same profile as those of FIG. 3 in both X and Y planes as shown in FIG. 4*b*. The angle $\theta$ is constant for all the multiplier surfaces and is the same as for FIG. 3.

Figure 5:
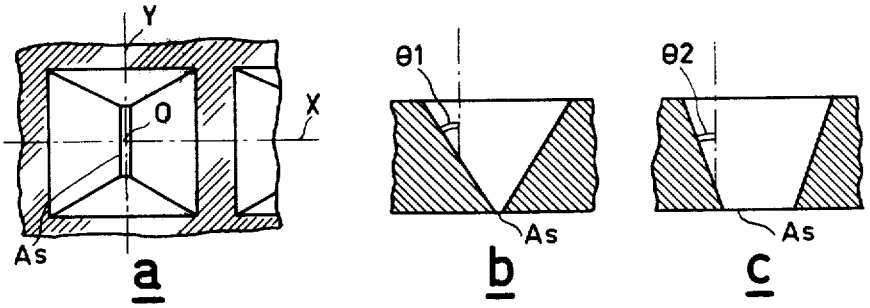

Whereas a regular pyramidal form is preferred for most purposes, it is possible to have an irregular pyramidal form e.g. as shown in FIG. 5. Here the small square exit aperture A2 of the channel is replaced by a slit aperture As and the profile along plane X differs from that taken along plane Y as shown in FIGS. 5*b* and 5*c* respectively. The operative multiplier surfaces of the channel have different inclination angles $\theta 1$ and $\theta 2$ for the two pairs of sides of the pyramid.

Figure 6:
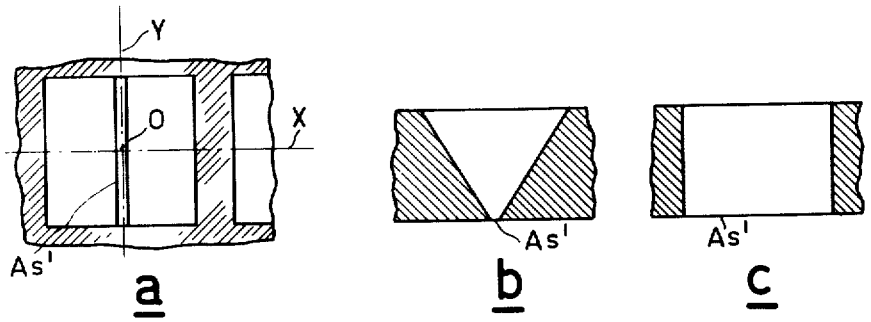

The form of channel shown in FIG. 5 can be modified further until there are only two opposite multiplier surfaces and the exit aperture is extended into a slit As' which extends right across a width equal to that of the input aperture. This "ridge" form is illustrated in FIG. 6 which shows again axial sections taken on the planes X (FIG. 6*b*) and Y (FIG. 6*c*). This arrangement has the disadvantage that it is more difficult to manufacture a plate by the aforesaid pressing, stamping, molding and like techniques.

Figure 7:
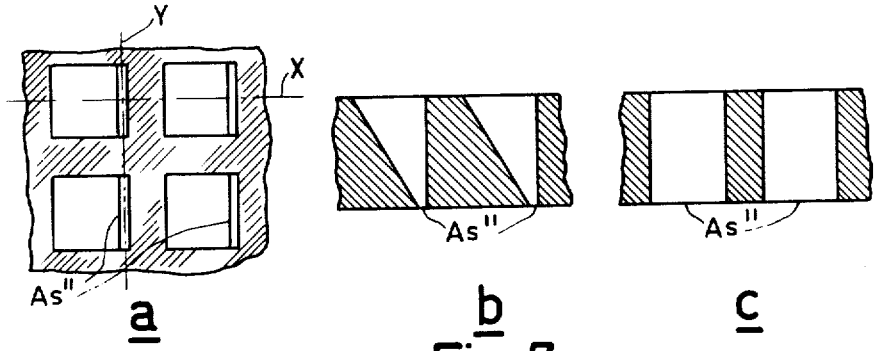

As a further variant the channels may have a form corresponding to one half of a ridge-type channel such as the channel shown in FIG. 6. Such a variant is shown in FIG. 7 and it will be seen that a greater number of square channels can be accommodated for the same $\theta$ angle and plate thickness. This arrangement is no longer symmetrical in that the exit slit (As'') is on one side and there is only one multiplier surface. (The axis 0 is taken as passing through the center of the exit slit).

Figure 8:
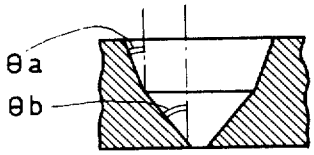

Hitherto the channel forms described have all had straight profiles. However, it is possible in each of the above examples to break each profile into two or more rectilinear steps. Thus, for example, the profiles of FIGS. 3 to 7 can be broken into two sections having differing angles of inclination $\theta$a and $\theta$b (for example 15° and 35°) and this is illustrated in FIG. 8. This results effectively in a concave profile. In the case of FIG. 3 this modification results in a channel having the form of two consecutive frusto-conical surfaces having different angles. In the case of pyramidal forms such as those of FIGS. 4 and 5 or the ridge form of FIG. 6, the result is a stepped pyramid or ridge in which the two parts of the pyramid or ridge have different inclinations.

Figure 9:
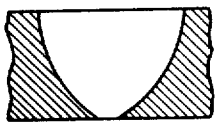

Of course, a larger number of inclined sections can be used and the principle can be taken further by adopting a smooth curved profile e.g. as shown in FIG. 9. This, again, can be applied to any of the forms shown in FIGS. 3 to 7, the pyramidal forms being thus changed into forms defined by four curved surfaces connecting the edges of the input aperture to an apex constituted by a pin-hole or slit exit aperture.

In those cases in which the channels include orthogonal surfaces (i.e. surfaces normal to the faces of the plate) extending between the edges of the inclined multiplier surfaces, such orthogonal surfaces are not provided as multiplier surfaces although in practice they may incidentally provide small gains slightly in excess of unity. This is all the more likely as it is usually difficult to apply a secondary-emissive coating to the inclined surfaces without the coating material landing also on the orthogonal surfaces. Such orthogonal surfaces appear in FIGS. 6 and 7.

The tube construction of FIG. 1 can be used for imaging or non-imaging multiplier applications. As an alternative to such a tube of the "proximity" type, it is possible to apply the invention to a tube of the "electronoptical diode" or "inverter" type having a conical anode or equivalent electrode structure.

The invention may also be used for imaging tubes other than image intensifiers, for example cathode-ray display tubes and camera tubes. In particular, the channel plate and grid structure of FIG. 1 may be used to intensify a scanning electron beam produced by an electron gun instead of the distributed electron emission of photo-cathode PC.

If a channel plate according to the invention is applied to a color T.V. display tube of the indexing type having a tricolor phosphor screen composed of vertical stripes, the channel configurations of FIGS. 5 to 7 are advantageous in that they can provide a spot which is elongated in the vertical direction.

Whereas the examples of FIGS. 1 to 9 relate to tapered forms in which the axial sections are straight (FIGS. 1 to 7) or concave (FIGS. 8 and 9) it is also possible to use forms having axial sections that are convex. A curved example of such a form is shown in FIG. 10 and it will be understood that stepped equivalents can also be used, i.e. arrangements in which the tapered form is obtained as a succession of two or more frusto-conical surfaces analogous to the form shown in FIG. 8.

Figure 10:
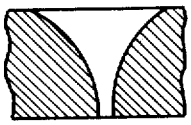

The configuration of FIG. 10 may be designed so as to operate efficiently without the grid G which is shown in FIG. 1 and assumed to be present in the description of FIGS. 2 to 9 for the purpose of controlling the form of the equipotentials on the input side. In fact, the type of tapered from shown in FIG. 10 can produce equipotential angles *e* (FIG. 2) within the preferred range 60° – 70° at or near the input aperture without the need for a grid G or equivalent means.

Reverting to the earlier examples and their electric field configuration, two points are worth making. First, the field configuration of FIG. 2 (which is based on surface conduction) is advantageous in that the area of highest field gradient is around the exit aperture and, since such area will cause most of the collisions and, therefore, most of the gain, most of the primary electrons captured by the channel will benefit from this high-gain area. Conversely, with bulk conduction the equipotentials are crowded near the input aperture of the channel and therefore many primary electrons will miss the high-gain area by landing farther down the tapered surface.

Figure 11:
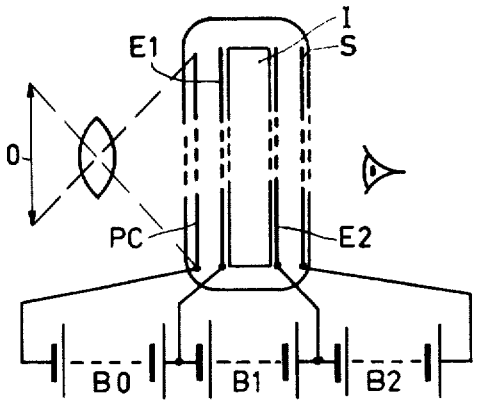

The second point is that the grid G may be replaced by equivalent field controlling means, a typical example being a photo-cathode used when the channel plate is employed in an image intensifier tube of the proximity type. FIG. 11 of the accompanying drawings illustrates schematically the use of channel plates in accordance with the invention in such an imaging tube. In the example given a channel plate I (which may be as described with reference to any of FIGS. 1 to 9) is shown inside the envelope of an image intensifier tube containing also a photo-cathode PC and a luminescent screen S. The input and output electrodes of the channel plate are shown at E1 and E2 respectively and an object 0 is shown imaged on to the photo-cathode.

Figure 12:
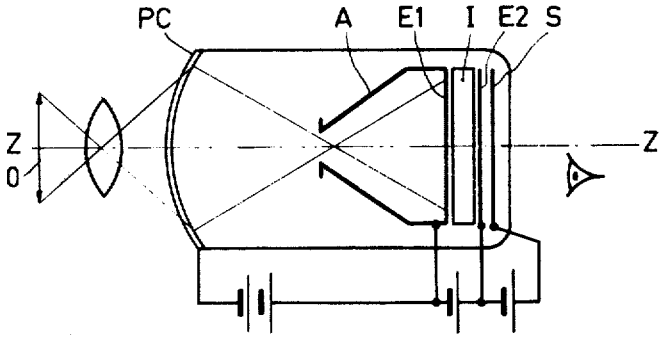

By contrast FIG. 12 shows schematically a tube of the "electron optical diode" or "inverter" type in which corresponding elements have the same reference numerals. The tube employs a conical anode A connected to electrode E1 in known manner. In this case the channel plate 1 may be of the FIG. 10 type without a grid G. Alternatively, it may be as described with reference to any of FIGS. 1 to 9 in which case it may be provided with a grid G, or the field-shaping function of such a grid may be performed by an electron-permeable conductive film laid across the input apertures of the channels to prevent ion feedback in accordance with U.S. Pat. No. 3,603,832.

Figure 13:
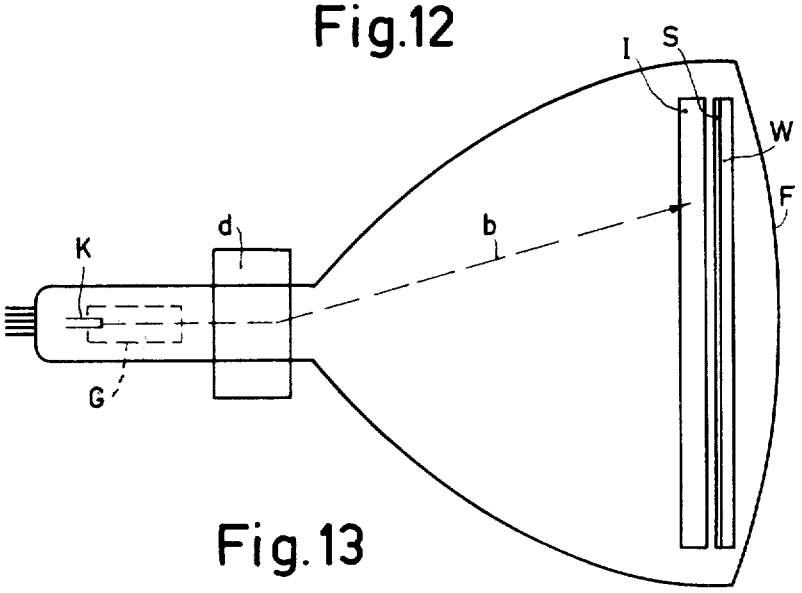

A third example of imaging tube is given in FIG. 13 which shows a cathode-ray display tube comprising an electron gun G (including a cathode K) for generating a beam *b* which is deflected by means *d* so as to scan a channel plate I constructed in accordance with the invention. The plate I is followed by a luminescent screen S which may be laid on a flat glass window or support W as shown. Alternatively, the screen S may be laid on a curved face-plate F forming part of the envelope, in which case the channel plate I may be correspondingly curved with the axis of each channel normal to the respective part of the channel plate. If the channel plate I is as described with reference to FIG. 10 it may not require a grid G, but if plate I is in accordance with FIGS. 1 to 9 it will be desirable to provide a grid G since no other equivalent field-shaping element is present in this example.

The profiles given in FIGS. 1 to 10 are all shown diagrammatically as having sharp edges at the exit apertures. Such sharp edges are not required and are unlikely to occur in practice. In the first place, a more rounded exit edge will be formed if the output electrode E2 is made to penetrate into the exit aperture as described above. Similarly, a more rounded or chamfered edge will normally result from the molding and pressing manufacturing methods referred to above. However, it may be positively desirable for each channel exit to be followed by a diverging extension or duct which does not form part of the channel multiplier proper. There may be various reasons for such a construction, one being the provision of greater rigidity for the channel plate, especially in flat large-area applications. Since the flared extension opens out, this will normally prevent the landing of output electrons on the extension walls. Such walls may be conductive or, alternatively, said walls may be resistive so as to set up a field gradient to provide additional acceleration for the output electrons from the channel.

Figure 14:
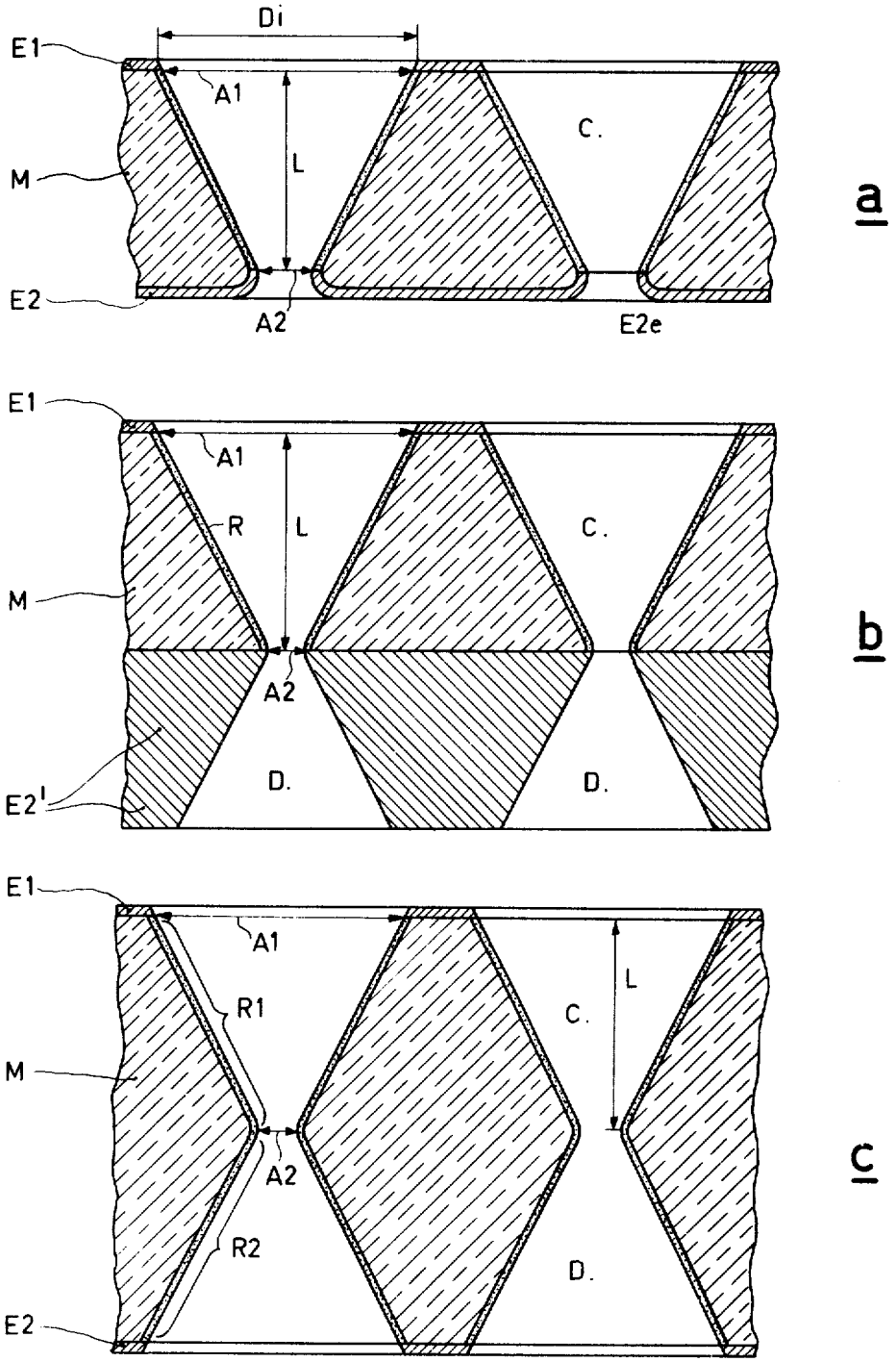

Constructions having such extensions are shown diagrammatically in FIG. 14, the aforesaid parameters L, and Di, being indicated in each case and also the positions of the input and exit apertures A1–A2 from which the Ai/Ae area ratio is determined.

FIG. 14*a* shows a profile similar to that of FIG. 1 which may relate to conical or square pyramidal channels C in accordance with FIGS. 3 and 4. The only modification is the re-entrant edge E2*e* of the output electrode E2 at the exit aperture which, as aforesaid, may permit many of the final collisions to take place on the electrode extension so that a relatively large part of the required current can be drawn directly from the HT supply circuit. For the purpose of measuring the L/Di ratio, the length L is the axial length of the resistive and secondary-emissive surface (R) of the channel as shown (the examples of FIG. 14 are shown as surface-conduction structures with an insulating matrix M or equivalent but they may also be applied to a bulk-conductive matrix).

FIG. 14*b* shows an arrangement similar to FIG. 14*a* except that the output electrode has been enlarged from a thin layer E2 to an element of plate or sheet form E2′ having a thickness comparable to that of the matrix M and diverging channel extensions or ducts D of a size and form which may be similar to that of the channels.

FIG. 14*c* shows an arrangement similar to that of FIG. 14*b* except that the matrix proper has been extended to approximately twice its original thickness so as to accommodate both the channels C and their extensions D. The resistive multiplier layer R1 may be extended by an additional resistive layer R2 in series therewith in which case an accelerating field is set up in the duct D. Alternatively, the layer R2 may be a good conductor. The length L of a channel is as shown and as for FIG. 14*b* since the extension D is not used for multiplication. The matrix M may, if desired, be formed by bonding together two identical halves.

Figure 14D:
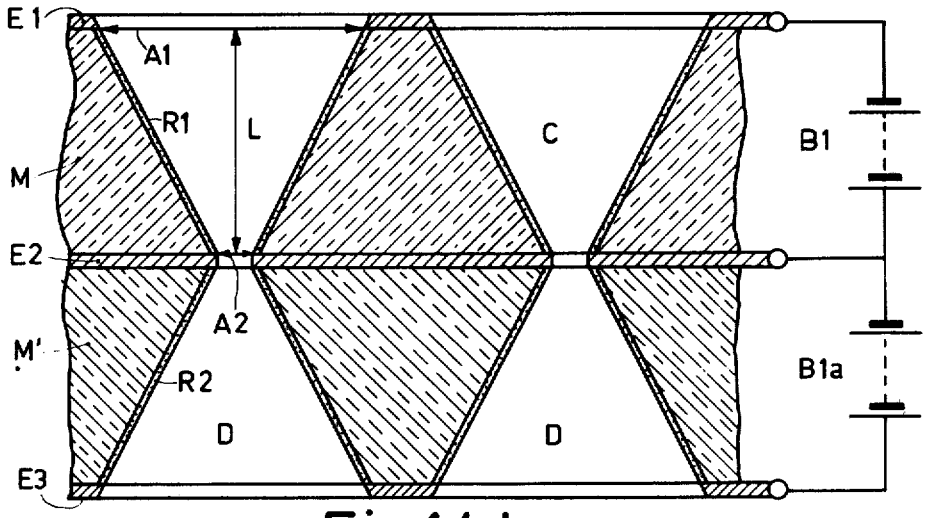

FIG. 14*d* shows a construction similar to that of FIG. 14*c* wherein the two halves M — M′ of the matrix are bonded together with the aid of the output electrode E2; an auxiliary electrode E3 is added if the surfaces R2 are resistive, in which case an auxiliary source B1*a* is added to enable the elements R1 – E3 to set up an accelerating field inside each duct D (if R2 is conductive, E3 and B1*a* are redundant).

As an alternative, or in addition to, the conductive and flared exit ducts D of FIGS. 14*b* to 14*d* each channel may, if desired, have a short parallel exit section having resistive-emissive walls provided as a continuation of surfaces R or R1. Such a parallel section will have to be taken as being within the operative length L of the channel and will therefore have to be short enough for the L/Di ratio to be less than 3 as required.

Figure 15:
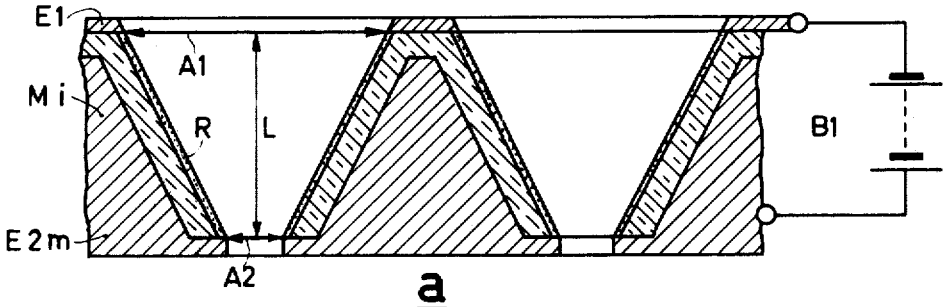
Figure 15:
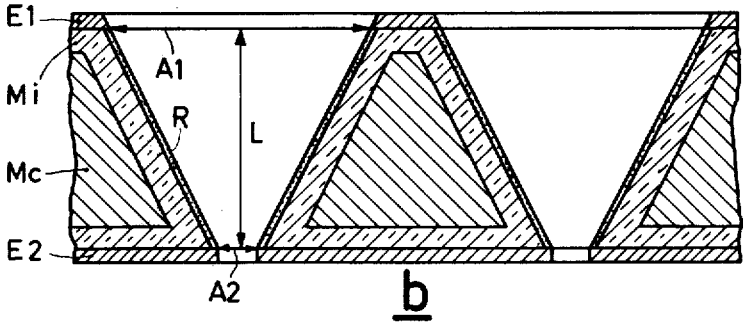
Figure 16:
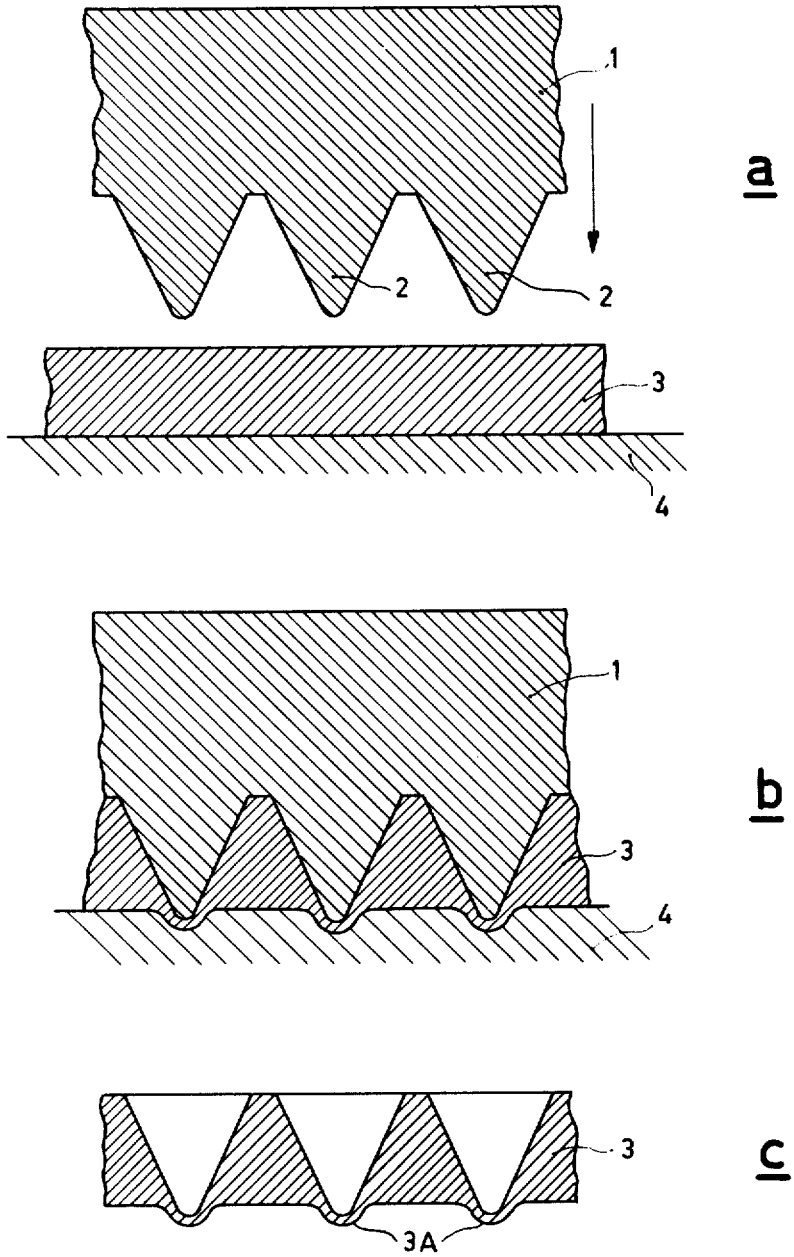
Figure 17:
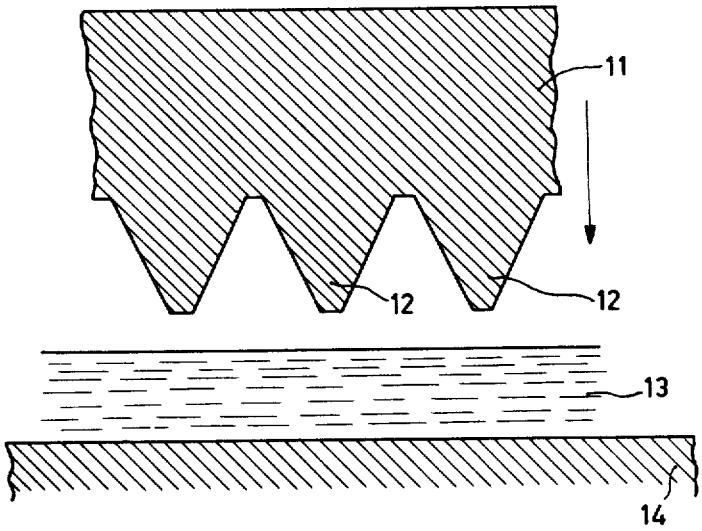
Figure 17:
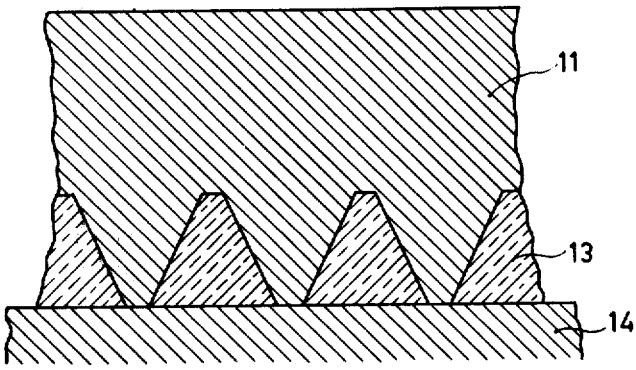

FIG. 15 shows two examples of the use of a conductor as the principle element of the matrix, the other element being a layer of insulating material Mi.

FIG. 15*a* shows a metal element E2*m* which acts partly as the output electrode and partly as a mechanical substrate for a thin matrix layer Mi of insulating material. The input electrode E1 is as before, and the resistive-emissive layer R extends from E1 to the exit section of element E2*m*.

The structure of FIG. 15*a* can readily be inverted so that the metal substrate acts also as input electrode while the output electrode is provided separately.

As a further alternative, the metal substrate may be a plate Mc surrounded completely by the layer of insulating material Mi as shown in FIG. 15*b*, the input and output electrodes E1 — E2 being both provided separately.

Substrate E2*m* of FIG. 15*a* may be formed in two parts, a layer E2 being applied separately.

The structures of FIGS. 15*a* and *b* are suitable for the aforesaid use of aluminum as the substrate with alumina provided (e.g. by anodization) as the insulator Mi.

In operation it appears that electrons travel only a small distance from the emissive surface before they are returned by the field at a shallow angle of incidence. This mechanism means that the process of multiplication is influenced considerably by any roughness of the emissive surface. Secondary electrons may fail to escape from deep cracks or craters and the equipotentials generated by a resistive coating on such rough surfaces may not favor efficient multiplication. Consequently it is desirable for the multiplying surfaces to be as smooth as possible, and satisfactory smoothness can be achieved by methods of manufacture which employ a master of complementary form to shape the material of the channel plate matrix, or of the substrate thereof in the case of a composite matrix (examples of composite structures are shown in FIGS. 15*a* and 15*b*. Such a master may be produced e.g. by machining appropriate grooves in a plate as described above, and two examples of methods using such masters will now be described with reference to FIGS. 16 and 17. The first is a pressing method wherein the master is used as a die, and the second is a molding method in which the master is used as a mould.

Referring to FIG. 16*a*, the die or pressing tool 1 is shown schematically in axial section as a plate having an array of conical, pyramidal or like projections 2. A piece of sheet metal 3 is laid on a rubber pad 4 which provides resilient support for the metal 3. FIG. 16*b* shows the die 1 forced down so as to deform the sheet metal and form therein an array of tapered channels. FIG. 16*c* shows the sheet metal 3 after removal of the die, with thin metal protrusions 3A which close the channel exits. The next step is to machine the output face of the metal sheet so as to remove the protrusions 3A and thus open the channel exit apertures. The metal substrate 3 is then coated partly or entirely with an insulating layer (e.g. as described with reference to FIGS. 15*a* or 15*b* and then an input and/or an output electrode layer is deposited on the insulator as appropriate.

Referring now to FIG. 17*a*, the master is shown schematically as a mold 11 having, again, an array of appropriate conical, pyramidal or like projections 12. Liquid or softened glass 13 is shown resting on a rigid base 14 forming part of the mold (the die 11 acts, in effect, as the lid in this case). FIG. 17*b* shows the mold 11 held forced against the base 14 while the glass solidifies with the channels formed in it. It may then be desirable or necessary to etch away any irregularities around the exit apertures of the channels, after which input and output electrode layers are applied to the two faces of the perforated glass matrix plate.

In each case, surface reduction may be used as aforesaid to form resistive channel surfaces if an insulating glass is used.

Although the input and output electrodes are continuous layers in the more usual applications, such an electrode may be subdivided into parallel strips for special applications.

What we claim is:

1. A channel plate electron multiplier, comprising a thin plate having two major faces and a plurality of closely spaced substantially identical channels interconnecting said two major faces, the axes of said channels being parallel to each other and a major part of each of said channels having a cross-section which is gradually tapered from an input aperture of one cross-section to an exit aperture of smaller cross-section, the ratio of the cross-sectional area of said input aperture to the cross-sectional area of said exit aperture being no less than five, the ratio between the axial distance spacing said input aperture from said exit aperture to the smallest linear dimension of said input aperture being no greater than three, the surfaces of said channels being resistive and secondary emissive at leas over said gradually tapered major part, and an electrostatic field controlling conductive structure adjacent to and extending across said input aperture for flattening any fringing electrostatic field generated within said channels to the extent that substantially all equipotential surfaces within said channels intersect with the surfaces of said tapered major part at an angle not less than fifty degrees nor greater than seventy-five degrees, in order that a major portion of secondary emitted electrons are thereby attracted back toward and collide with the secondary emissive surface of said tapered major part at a point closer to said exit aperture without crossing to and colliding with the opposite side of said tapered major part.

2. A channel plate electron multiplier as defined in claim 1 wherein said electrostatic field controlling conductive structure comprises a photo-cathode in close proximity with and covering said input apertures of said channels.

3. A channel plate electron multiplier as defined in claim 1 wherein said electrostatic field controlling conductive structure comprises an electron permeable conductive film covering said input apertures of said channels.

4. A channel plate electron multiplier as defined in claim 1 wherein said electrostatic field controlling conductive structure comprises an electrically conductive grid covering said input apertures of said channels.

5. A channel plate electron multiplier as defined in claim 1 wherein the ratio of the cross-sectional area of said input aperture to the cross-sectional area of said exit aperture is no less than twenty and the ratio between the axial distance spacing said input aperture from said exit aperture to the smallest linear dimension of said input aperture is no greater than two.

6. A channel plate electron multiplier as defined in claim 1 wherein the ratio of the cross-sectional area of said input aperture to the cross-sectional area of said exit aperture is no less than twenty-five and the ratio between the axial distance spacing said input aperture from said exit aperture to the smallest linear dimension of said input aperture is no greater than one.

7. A channel plate electron multiplier as defined in claim 1 wherein substantially all of said equipotential surfaces intersect with the surfaces of said tapered major part at an angle not less than 60° not greater than 70°.

8. A channel plate electron multiplier as defined in claim 1 wherein said gradually tapered major part has the shape of a truncated cone with an apical angle between 20° and 120°.

9. A channel plate electron multiplier as defined in claim 1 wherein said gradually tapered major part has the shape of a truncated pyramid.

* * * * *